US010668756B2

(12) United States Patent
Ishikawa et al.

(10) Patent No.: US 10,668,756 B2
(45) Date of Patent: Jun. 2, 2020

(54) PRINTER

(71) Applicant: FUJITSU COMPONENT LIMITED, Tokyo (JP)

(72) Inventors: Tetsuhiro Ishikawa, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/245,335

(22) Filed: Jan. 11, 2019

(65) Prior Publication Data

US 2019/0224997 A1 Jul. 25, 2019

(30) Foreign Application Priority Data

Jan. 22, 2018 (JP) ..... 2018-007960

(51) Int. Cl.

| | |
|---|---|
| ***B41J 29/13*** | (2006.01) |
| ***B41J 29/02*** | (2006.01) |
| ***B41J 2/32*** | (2006.01) |
| ***B65H 29/20*** | (2006.01) |

(52) U.S. Cl.

CPC ..... *B41J 29/13* (2013.01); *B41J 2/32* (2013.01); *B41J 29/02* (2013.01); *B65H 29/20* (2013.01)

(58) Field of Classification Search

CPC ... B41J 29/02; B41J 29/13; B41J 2/32; B65H 29/20

USPC ..... 347/222

See application file for complete search history.

(56) References Cited

U.S. PATENT DOCUMENTS

| | | | | |
|---|---|---|---|---|
| 6,443,645 | B1 | 9/2002 | Takei et al. | |
| 8,711,194 | B2 | 4/2014 | Tsuchiya et al. | |
| 2008/0013999 | A1* | 1/2008 | Izuchi | B41J 13/025 399/393 |
| 2013/0334947 | A1 | 12/2013 | Wu | |
| 2017/0267000 | A1 | 9/2017 | Takahashi | |

FOREIGN PATENT DOCUMENTS

| | | |
|---|---|---|
| JP | H11-129571 | 5/1999 |
| JP | 2014-043083 | 3/2014 |
| JP | 2017-30280 | 2/2017 |

* cited by examiner

*Primary Examiner* — Huan H Tran
*Assistant Examiner* — Alexander D Shenderov
(74) *Attorney, Agent, or Firm* — IPUSA, PLLC

(57) ABSTRACT

A printer includes a body, a cover, a long hole formed in one of the body and the cover, a first shaft provided on another one of the body and the cover and disposed to pass through the long hole, a groove formed in the one of the body and the cover, and a second shaft provided on the other one of the body and the cover and disposed to pass through the groove. The cover is attached to the body so as to be rotatable around the first shaft, the groove extends parallel to the longitudinal direction of the long hole, the cover is slidable relative to the body while the second shaft is in the groove, and the cover is rotatable around the first shaft when the second shaft is out of the groove.

3 Claims, 20 Drawing Sheets

PRINTER

CROSS-REFERENCE TO RELATED APPLICATION

The present application is based on and claims priority to Japanese Patent Application No. 2018-007960, filed on Jan. 22, 2018, the entire contents of which are incorporated herein by reference.

BACKGROUND OF THE INVENTION

1. Field of the Invention

An aspect of this disclosure relates to a printer.

2. Description of the Related Art

Printers for printing receipts are widely used, for example, for cash registers in shops, and for automated teller machines (ATM) and cash dispensers (CD) in banks. In such a printer, information is printed by a print head on rolled recording paper while the paper is being fed, and the paper is cut with a cutter after the predetermined length of the recording paper is fed.

There is a known printer that includes a printer body and a cover connected to the printer body. For example, one of a thermal head and a platen roller is attached to the printer body, and the other one of the thermal head and the platen roller is attached to the cover (see, for example, Japanese Laid-Open Patent Publication No. H11-129571). When setting paper in the printer with this configuration, the cover is opened to form a space between the printer body and the cover, and the paper is inserted into the space.

A printer is described with reference to FIGS. 1A and 1B. The printer illustrated in FIGS. 1A and 1B includes a body 910 and a head unit 920 that are connected to each other via two arms 930. A platen roller 911 is attached to the body 910, and a thermal head is attached to the head unit 920.

To set paper in the printer, the head unit 920 as illustrated in FIG. 1A is lifted and moved apart from the body 910 as illustrated in FIG. 1B to form a space 940 between the body 910 and the head unit 920. The paper is set in the printer by passing the paper through the space 940 in a direction indicated by an arrow 1A.

As described above, paper is set in the printer by lifting the head unit 920 from the body 910. With this configuration, the head unit 920 becomes an obstruction in passing paper through the space 940, and it takes time and troublesome to set paper in the printer. Although it is possible to reduce time for setting paper by configuring the printer such that the head unit 920 can be lifted to a higher position from the body 910 and the space 940 can be widened. However, this configuration requires larger arms 930 and is therefore not suitable in terms of downsizing and strength.

To solve the above problems, Japanese Laid-Open Patent Publication No. 2014-043083, for example, discloses a printer that enables easy installation of paper. The disclosed printer is configured such that a cover to which a head unit is attached is opened by rotating the cover around a first shaft connecting the cover to a body and further rotating the cover around a second shaft that is orthogonal to the first shaft.

However, with the configuration where the cover is rotated around the first shaft and then further rotated around the second shaft, a larger space is necessary to open the cover. Also, it is not easy to rotate the cover around the second shaft after rotating the cover around the first shaft. Particularly, when the cover is operated in a hurry, force may be applied in a direction other than the rotational direction and as a result, a part connecting the cover to the body may be deformed and the cover may become not closable.

For the above reasons, there is a demand for a small printer whose cover can be easily opened and closed to set recording paper.

SUMMARY OF THE INVENTION

In an aspect of this disclosure, there is provided a printer that includes a body, a cover, a long hole formed in one of the body and the cover, a first shaft provided on another one of the body and the cover and disposed to pass through the long hole, a groove formed in the one of the body and the cover, and a second shaft provided on the other one of the body and the cover and disposed to pass through the groove. The cover is attached to the body so as to be rotatable around the first shaft, the groove extends parallel to the longitudinal direction of the long hole, the cover is slidable relative to the body while the second shaft is in the groove, and the cover is rotatable around the first shaft when the second shaft is out of the groove.

DESCRIPTION OF EMBODIMENTS

Embodiments of the present invention are described below with reference to the accompanying drawings.

Throughout the drawings, the same reference number is assigned to the same component, and repeated descriptions of the same component are omitted. In the present application, an X1-X2 direction, a Y1-Y2 direction, and a Z1-Z2 direction indicate directions that are orthogonal to each other; an XY plane indicates a plane including the X1-X2 direction and the Y1-Y2 direction; a YZ plane indicates a plane including the Y1-Y2 direction and the Z1-Z2 direction; a ZX plane indicates a plane including the Z1-Z2 direction and the X1-X2 direction, the X1 side is referred to as a right side, and the X2 side is referred to as a left side.

<Configuration of Printer>

Figure 1A:
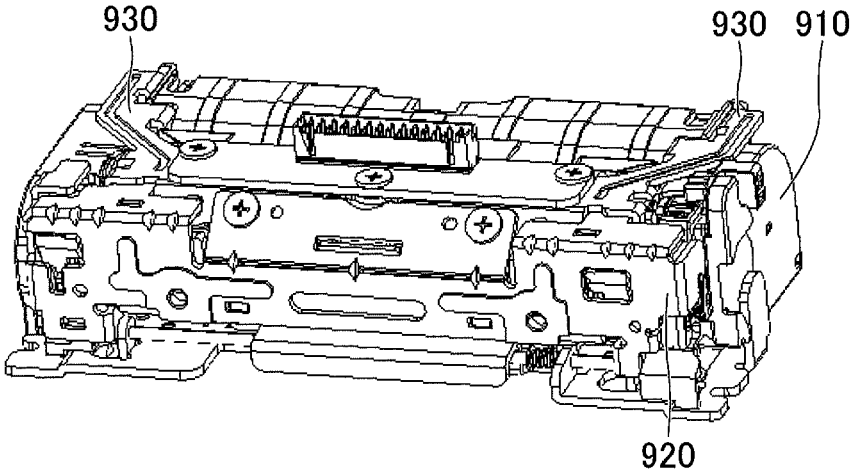
FIGS. 1A and 1B are drawings illustrating a printer including a cover.
Figure 1B:
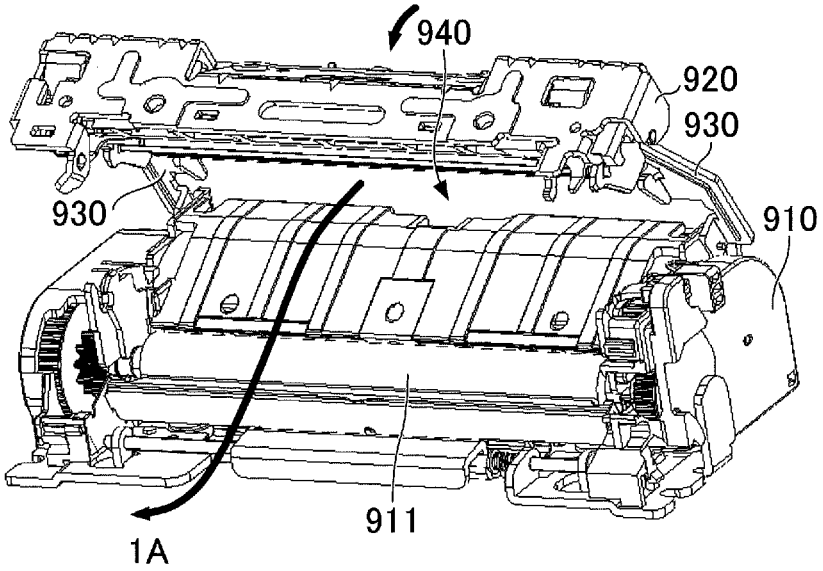
Figure 2:
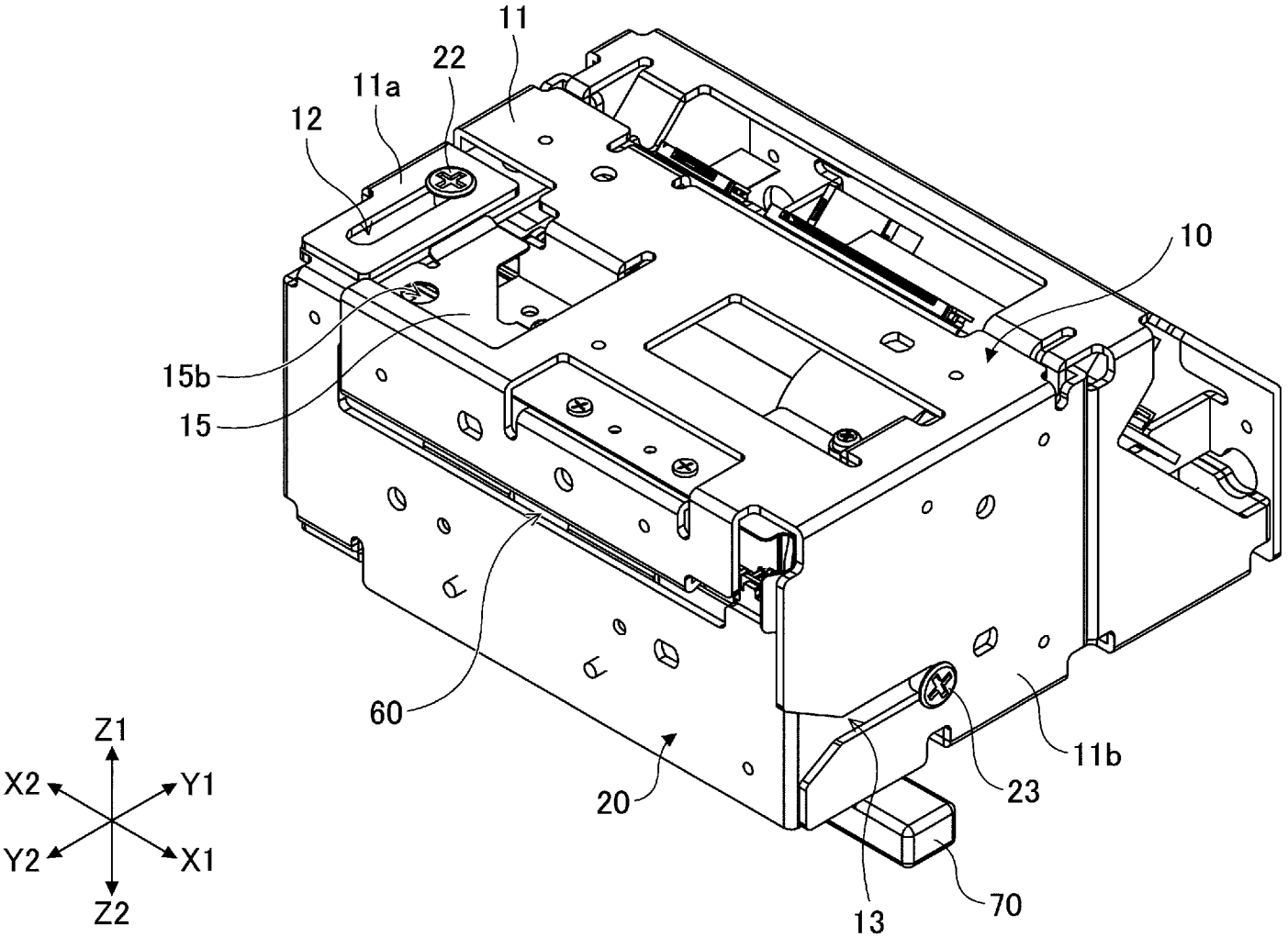
FIG. 2 is a perspective view of a printer of an embodiment whose cover is closed.
Figure 3:
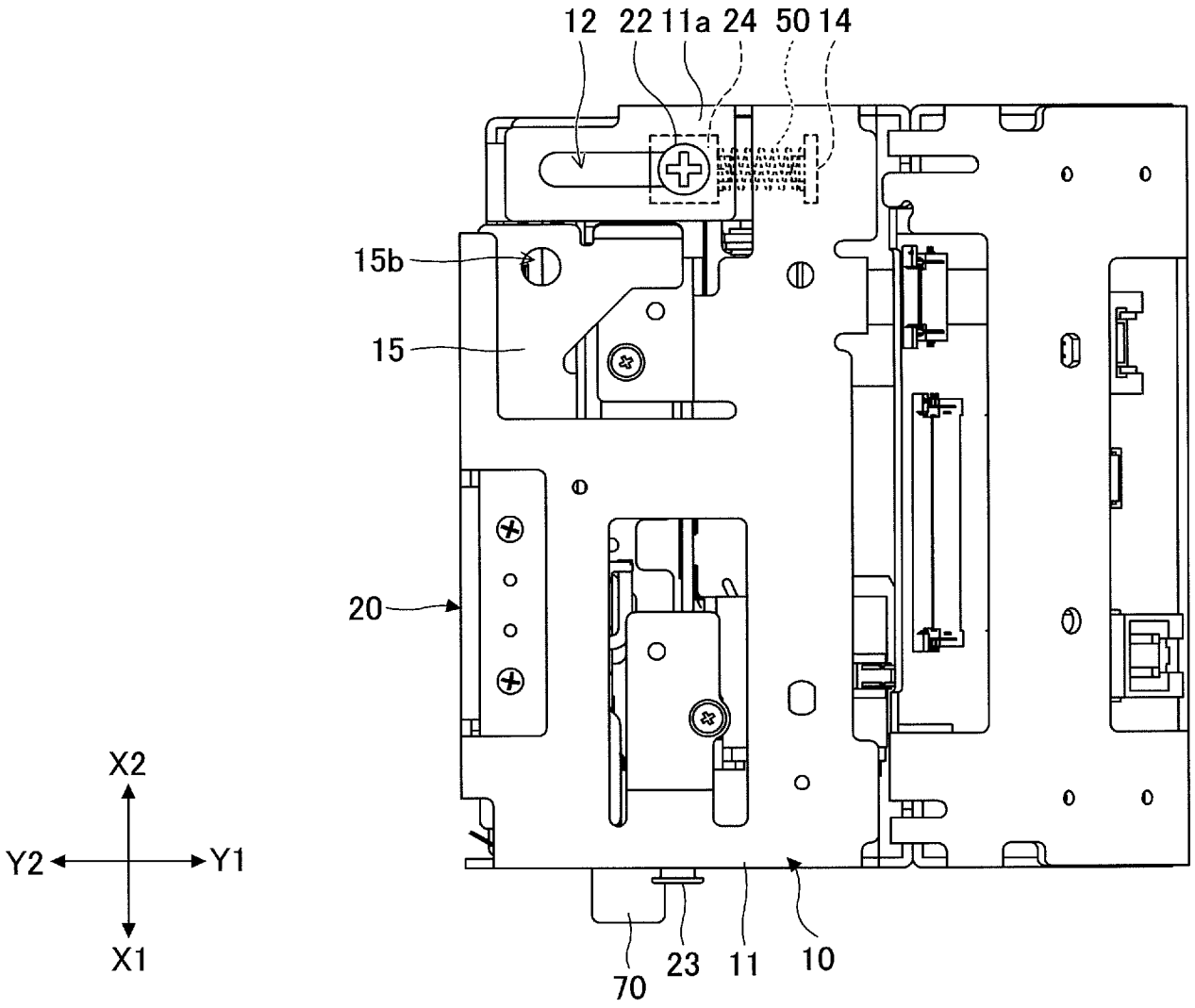
FIG. 3 is a top view of the printer whose cover is closed.
Figure 4:
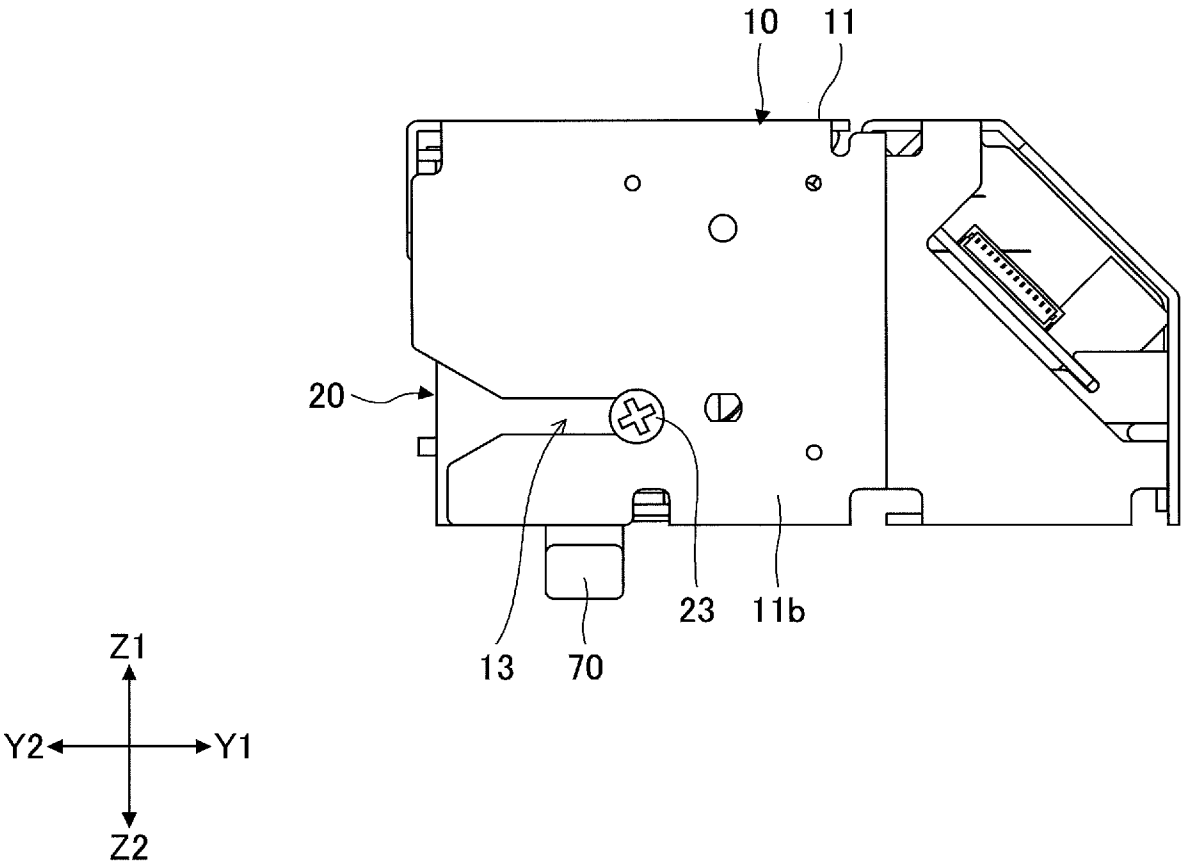
FIG. 4 is a right-side view of the printer whose cover is closed.
Figure 5:
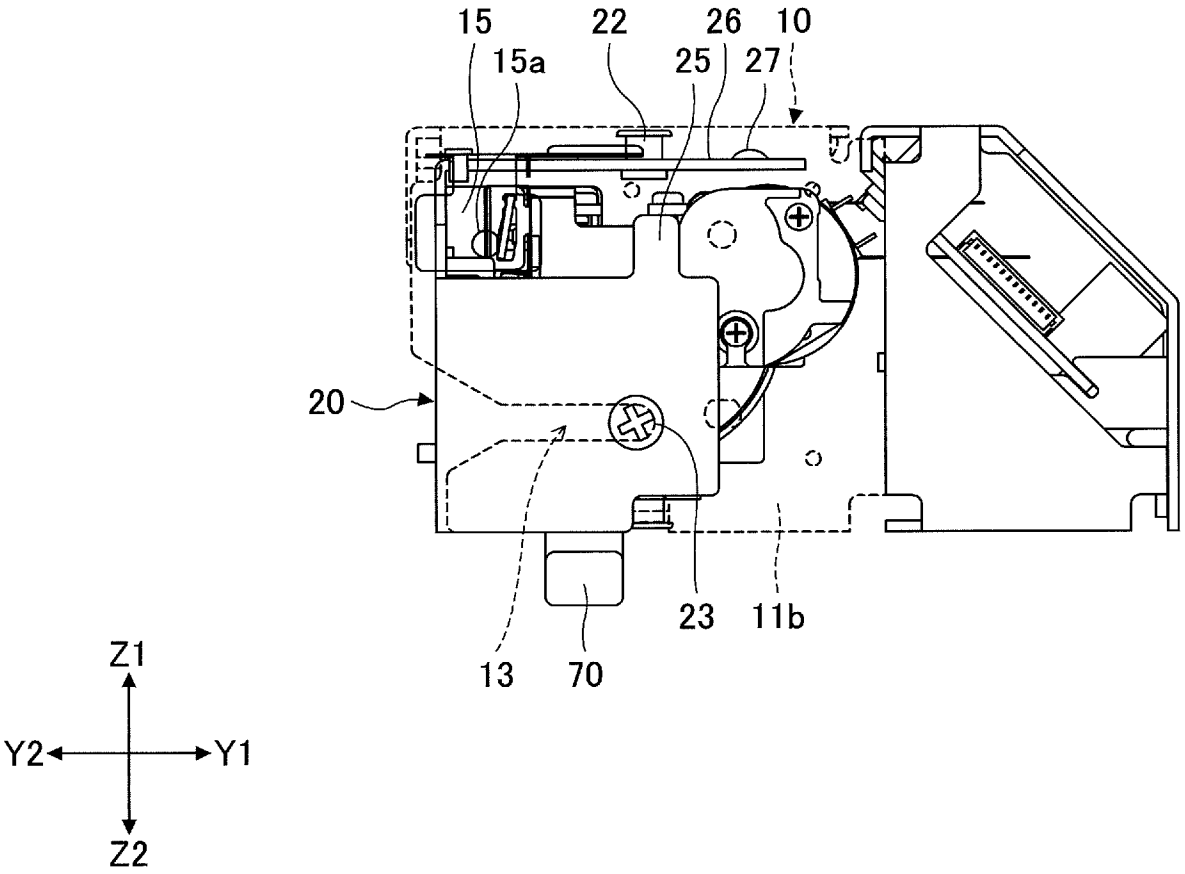
FIG. 5 is a transparent side view of the printer whose cover is closed.
Figure 6:
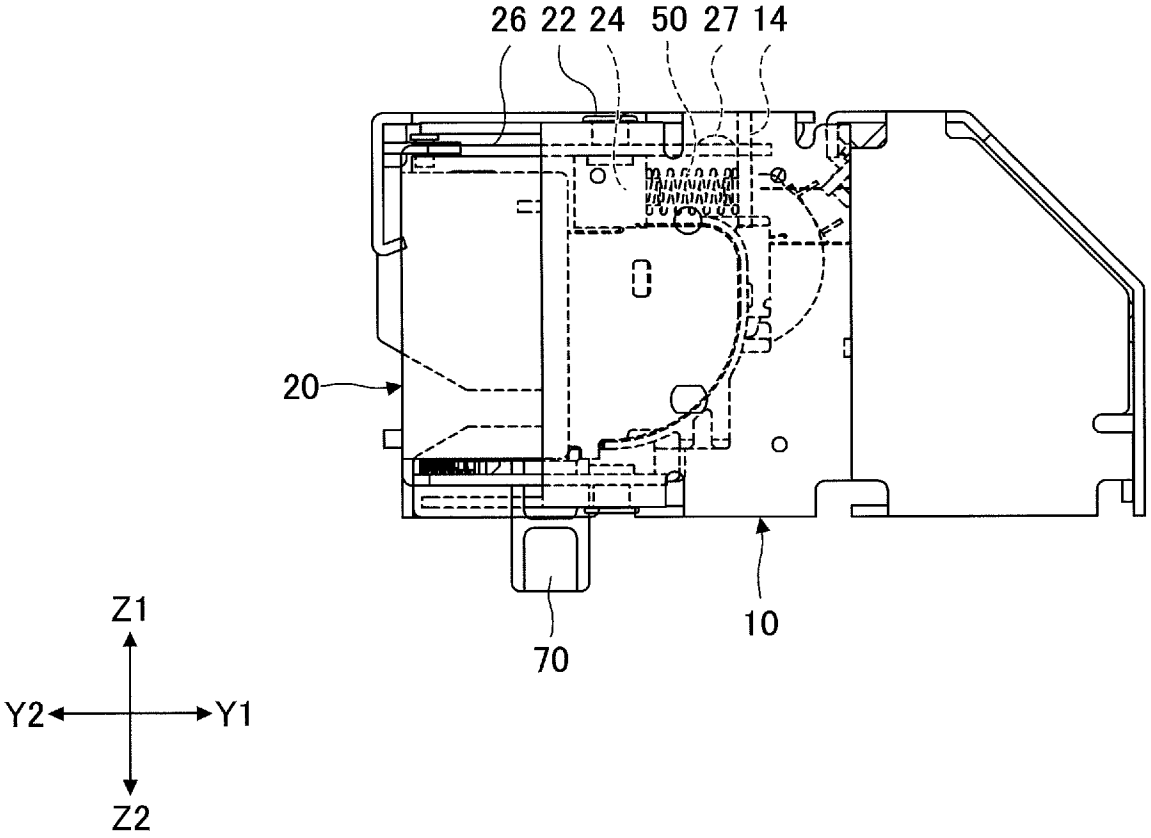
FIG. 6 is a transparent side view of the printer whose cover is closed.

A printer according to an embodiment is described with reference to FIGS. 2 through 6. FIGS. 2 through 6 illustrate a printer whose cover 20 is closed. FIG. 2 is a perspective view, FIG. 3 is a top view, and FIG. 4 is a right-side view of the printer. FIG. 5 is a side view of the printer where a part of a right-side wall of a housing is made transparent. FIG. 6 is a side view of the printer where a part of a left-side wall of the housing is made transparent.

The printer includes a body 10 and a cover that is openable and closable relative to the body 10. A thermal head 30, which is a print head, is provided in a housing 11 of the body 10. A platen roller 40 and a sheet guide 21 are provided on the cover 20.

In the present embodiment, the cover 20 is attached to the Y2 side of the body 10. A long hole 12 is formed in an upper wall 11*a* on the Z1 side of the housing 11, and a groove 13 is formed in a side wall 11*b* on the X1 side of the housing 11. The long hole 12 is disposed on the upper wall 11*a* and has a closed shape that is long in the Y1-Y2 direction. The groove 13 is disposed on the side wall 11*b* and is long in the Y1-Y2 direction. The Y2-end of the groove 13 is open.

A first pin or shaft 22 passing through the long hole 12 and a second pin or shaft 23 passing through the groove 13 are attached to the cover 20. In the present embodiment, a screw is used as "pin or shaft". However, any other component such as a pin having the same function as a screw may instead be used. Each of the first screw 22 and the second screw 23 includes a threaded shaft and a head having a diameter greater than the diameter of the shaft, and is attached to the cover 20 by inserting the shaft into a threaded hole formed in the cover 20. In FIG. 2, the first screw 22 passes through the long hole 12, and the second screw 23 passes through the groove 13. In the present application, the first screw 22 may be referred to as a "first shaft", and the second screw 23 may be referred to as a "second shaft".

A coil spring 50 is provided between the body 10 and the cover 20. One end of the spring 50 is in contact with a support 14 of the body 10, and another end of the spring 50 is in contact with a support 24 of the cover 20. In the state illustrated in FIGS. 2 through 6, a restoring force is generated in the direction in which the spring 50 expands, and because the spring 50 is in contact with the support 24, the cover 20 is biased in the Y2 direction.

A plate spring 15, which is a biasing part, is provided in the housing 11. A protrusion 15*a* protruding in the X1 direction is provided on the X1-side surface of the spring 15 that is parallel to the YZ plane, and a hole 15*b* is formed in the X2 side of a surface of the spring 15 that is parallel to the XY plane. An engaging part 25 protruding in the Z1 direction is provided in the X1-side surface of the cover 20. In FIGS. 2 through 6, the engaging part 25 is positioned closer to the Y1 end of the body 10 than the protrusion 15*a*. A protrusion 27 protruding in the Z1 direction is provided on a cover part 26 that is on the X2 side of the cover 20 and to which the first screw 22 is attached.

Figure 7:
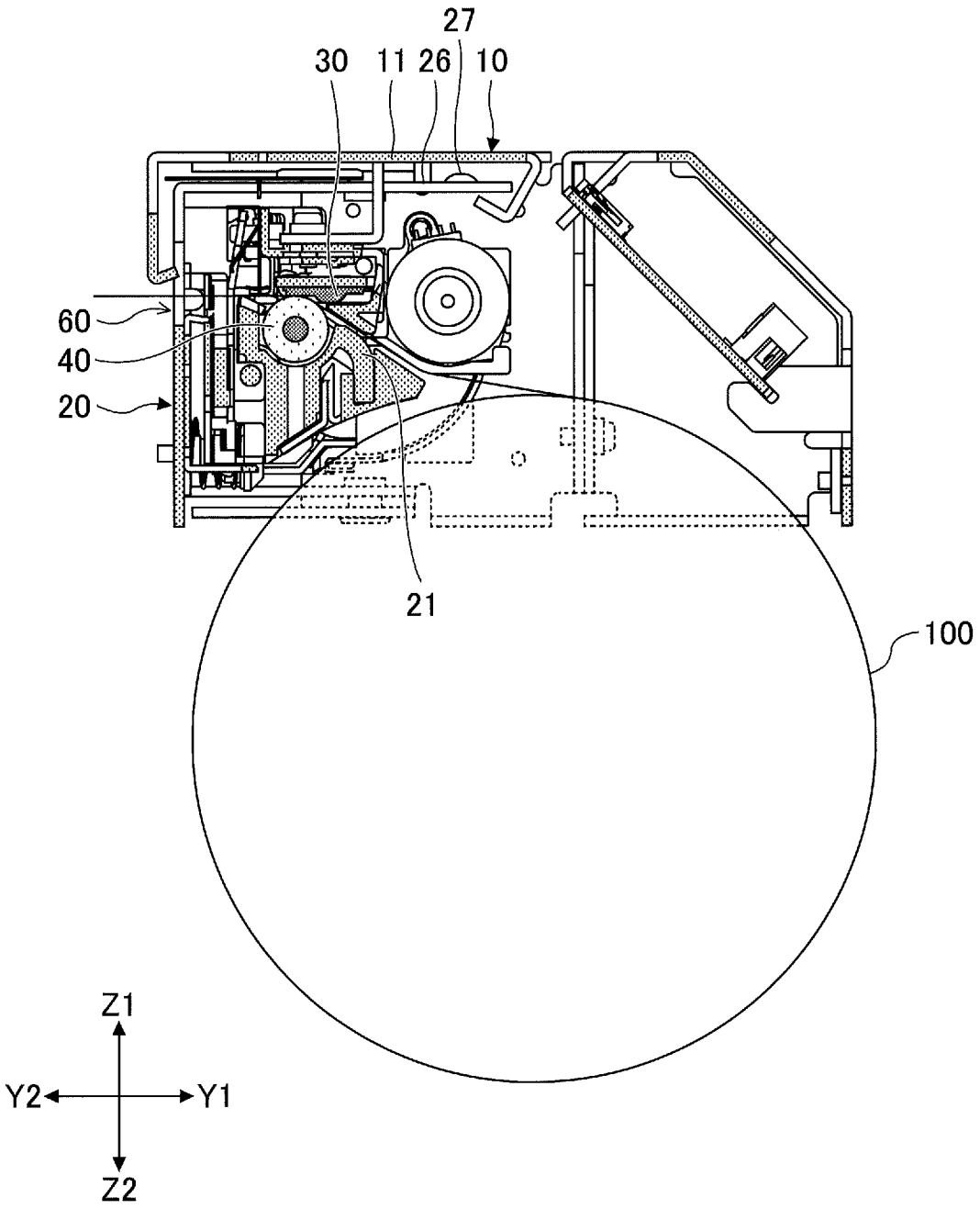
FIG. 7 is a cross-sectional view of the printer whose cover is closed.

In the present embodiment, as illustrated in FIG. 7, rolled recording paper 100 is placed in a sheet holder (not shown). The paper 100 is inserted between the thermal head 30 and the platen roller 40, and information is printed on the paper 100 by the thermal head 30 while the paper 100 is fed by the platen roller 40. After information is printed, the paper 100 is ejected through an ejection port 60 between the body 10 and the cover 20. A lever 70 for opening the cover 20 is provided on the Z2 side of the body 10.

<Cover Opening Operations>

Next, operations for opening the cover 20 according to the present embodiment are described. In the present embodiment, the printer can perform printing in a state illustrated in FIG. 2 through where the cover 20 is closed. However, when the paper 100 placed in the sheet holder is used up, it is necessary to supply a new roll of paper. Also, when the paper 100 is jammed between the thermal head 30 and the platen roller 40 or in the ejection port 60, it is necessary to remove the jammed paper 100. In these cases, it is necessary to open the cover 20. To open the cover 20, a space for the opened cover 20 is necessary. It is preferable to make this space as small as possible to prevent an increase in the size of an apparatus where the printer is to be installed.

Figure 8:
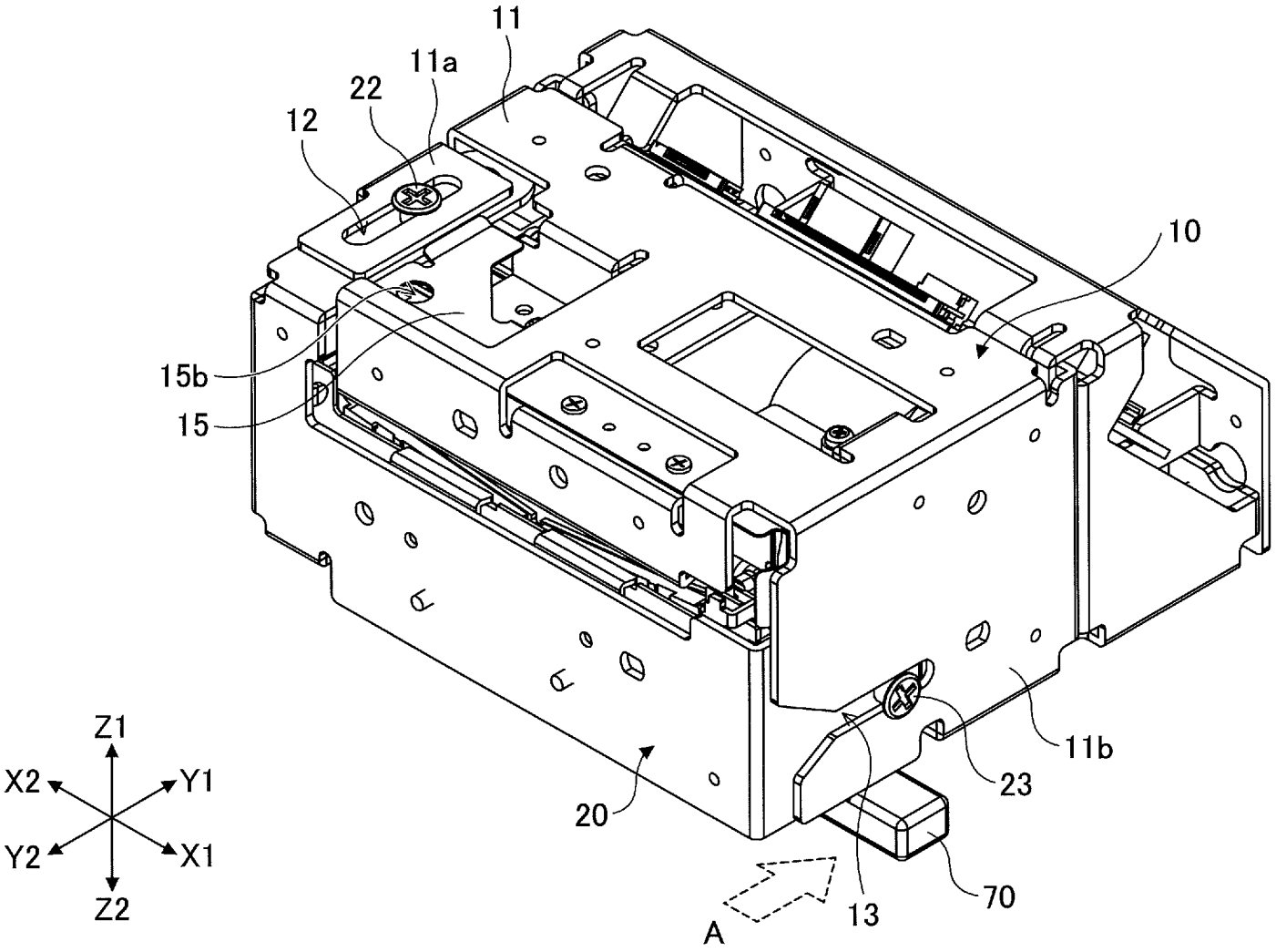
FIG. 8 is a perspective view of the printer whose cover is in the middle of being opened.
Figure 9:
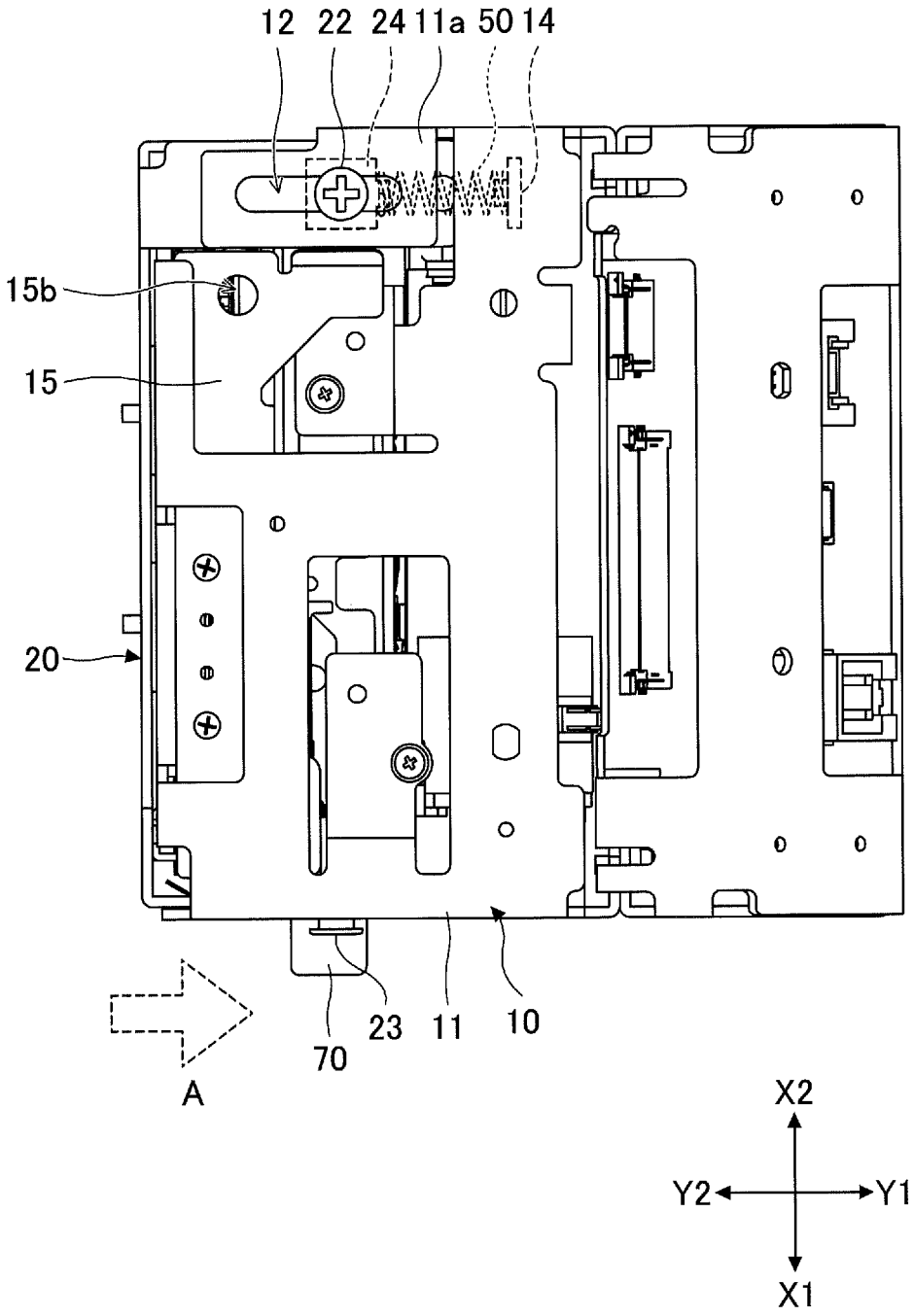
FIG. 9 is a top view of the printer whose cover is in the middle of being opened.
Figure 10:
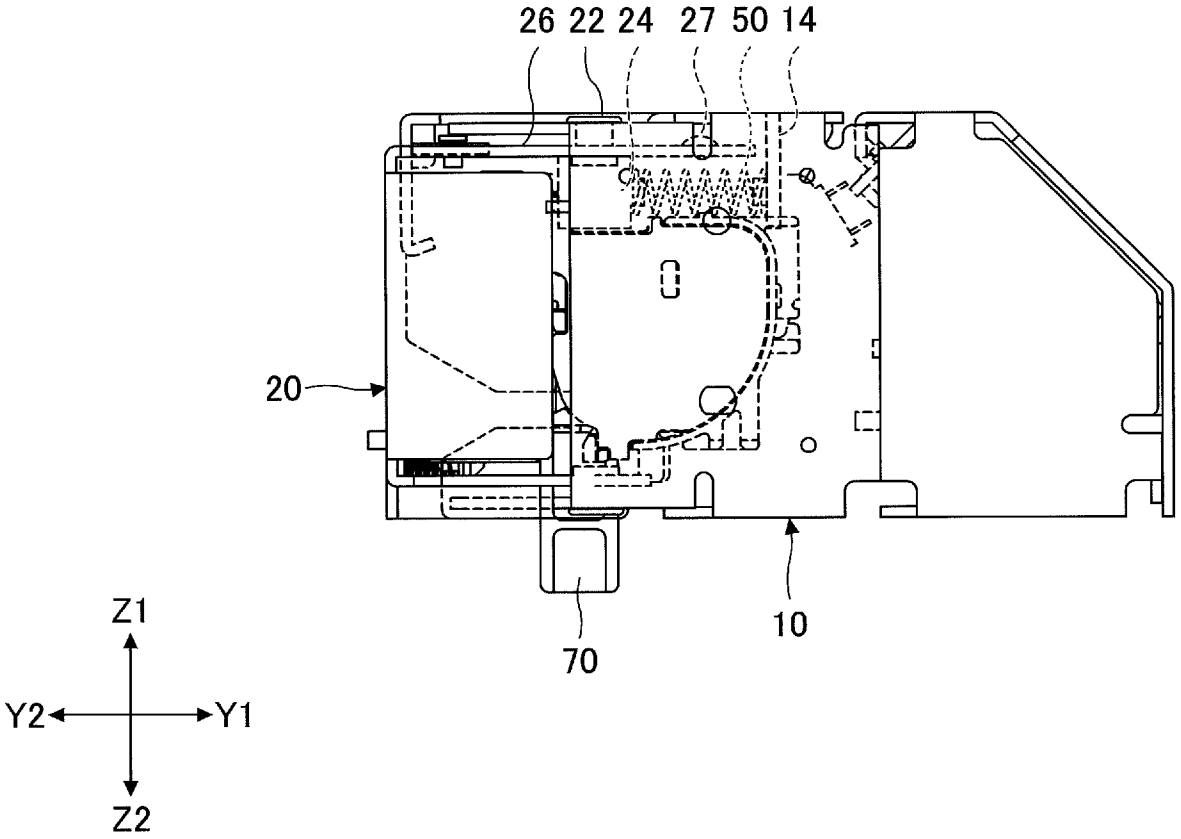
FIG. 10 is a transparent side view of the printer whose cover is in the middle of being opened.

Details of operations for opening the cover 20 are described. FIG. 8 is a perspective view, FIG. 9 is a top view, and FIG. 10 is a side view of the printer where the cover 20 is slightly opened by operating the lever 70. In FIG. 10, a part of the left side wall of the housing 11 is made transparent.

When the lever 70 is pressed in Y1 direction indicated by a dotted arrow A in the state as illustrated in FIGS. 2 through 7, engaging parts (not shown) of the body 10 and the cover 20 are disengaged from each other. As a result, the cover 20 is pressed by the spring 50 in the Y2 direction relative to the body 10 and slides in the Y2 direction as illustrated in FIGS. 8 through 10. The engaging parts are provided to keep the cover closed. In the state illustrated in FIGS. 8 through 10, the first screw 22 moves in the long hole 12 and the second screw 23 moves in the groove 13 in the Y2 direction, and the cover 20 slides in the Y2 direction relative to the body 10.

Figure 11:
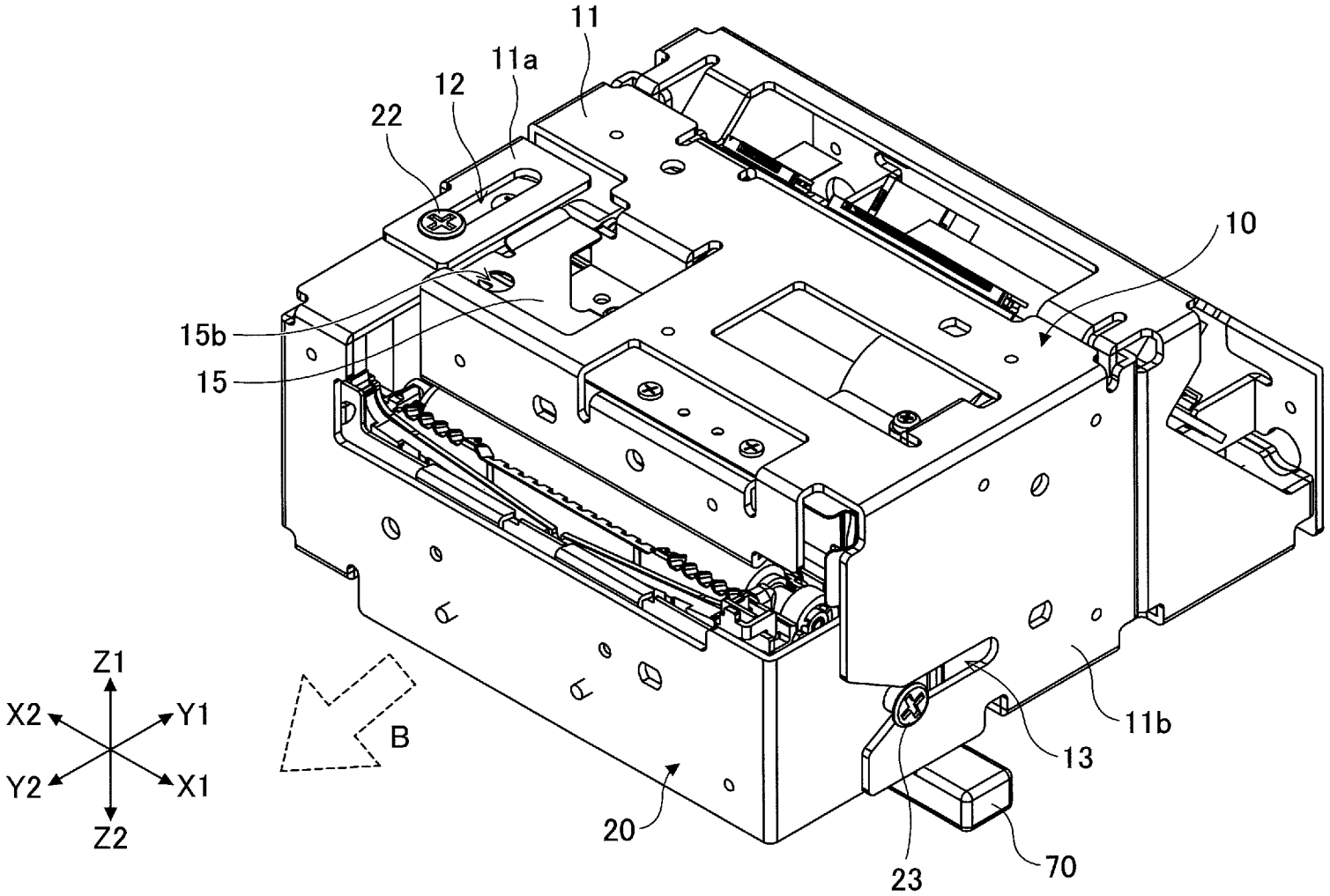
FIG. 11 is a perspective view of the printer whose cover is slid.
Figure 12:
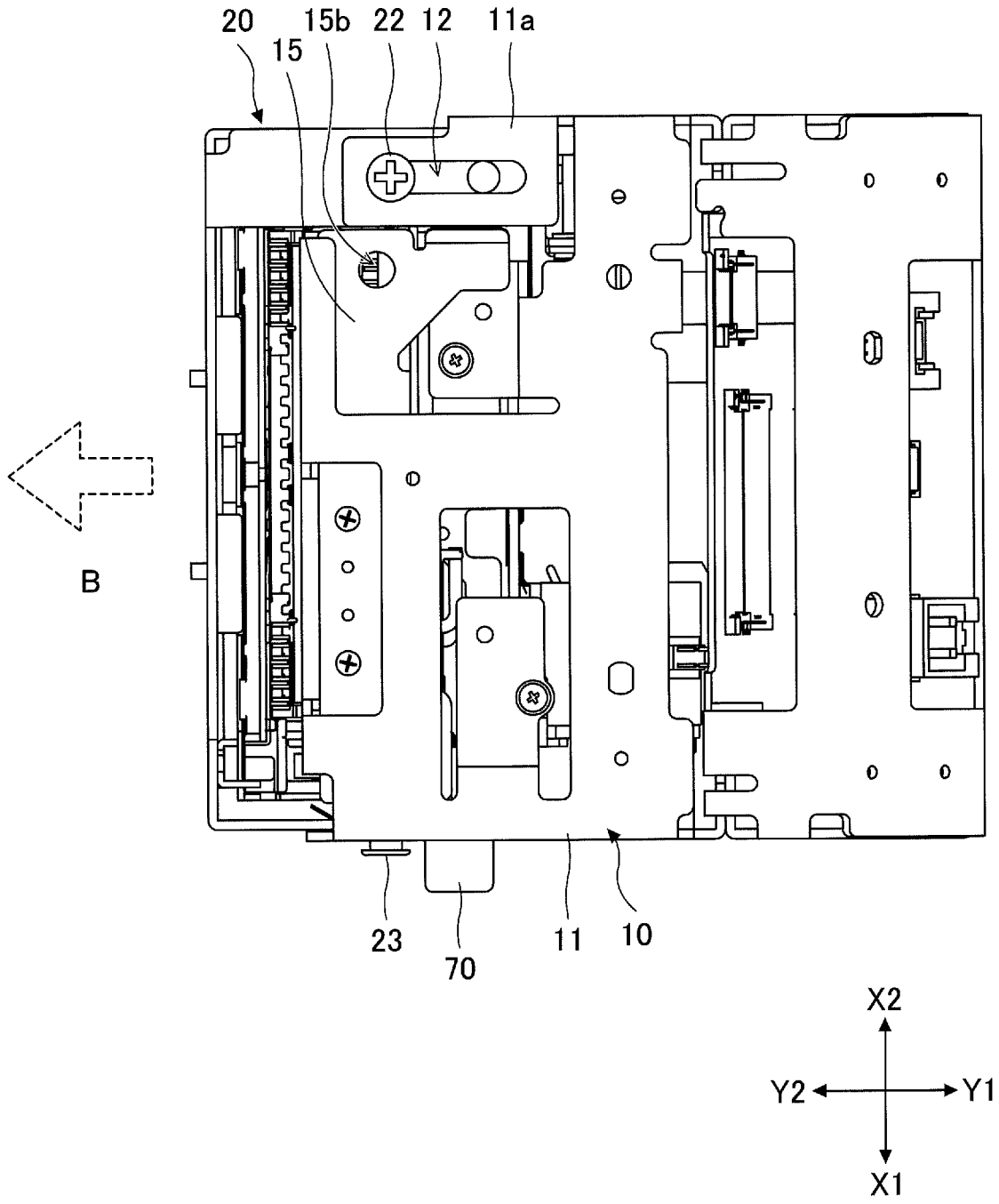
FIG. 12 is a top view of the printer whose cover is slid.
Figure 13:
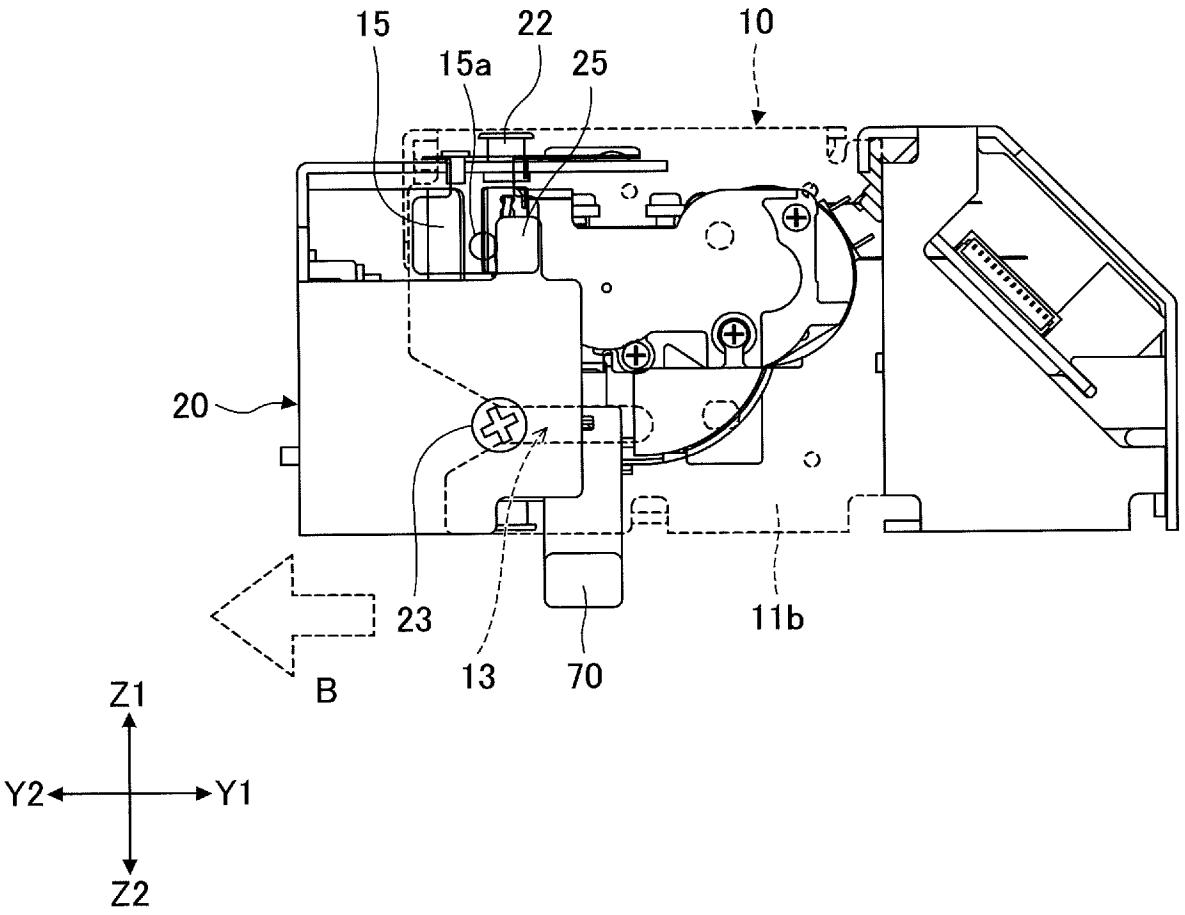
FIG. 13 is a transparent side view of the printer whose cover is slid.
Figure 14:
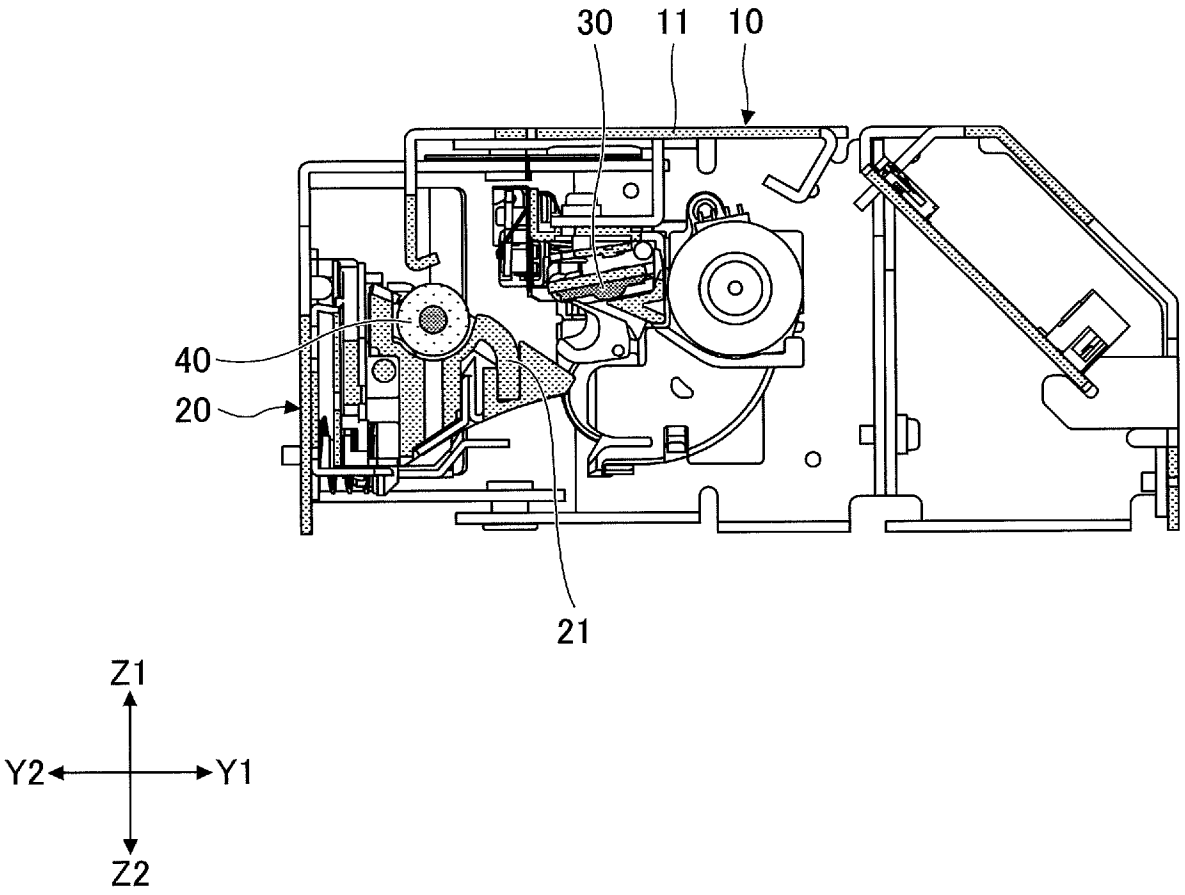
FIG. 14 is a cross-sectional view of the printer whose cover is slid.

FIG. 11 is a perspective view, FIG. 12 is a top view, FIG. 13 is a side view, and FIG. 14 is a cross-sectional view parallel to the YZ plane of the printer where the cover 20 is further opened. In FIG. 13, a part of the right side wall of the housing 11 is made transparent.

As illustrated in FIGS. 11 through 14, when the cover 20 is further moved in Y2 direction indicated by the dotted arrow B, the cover 20 slides in the Y2 direction relative to the body 10 and is partially pulled out of the body 10. In FIGS. 11 through 14, the first screw 22 moves in the long hole 12 in the Y2 direction, and the second screw 23 moves in the groove 13 in the Y2 direction.

Also, in the state illustrated in FIGS. 11 through 14, the engaging part 25 is positioned closer to the Y1 end of the body 10 than the protrusion 15*a* in the sliding direction of the cover 20. As illustrated in FIG. 13, the Y1 end of the protrusion 15*a* is in contact with the Y2 end of the engaging part 25. As a result, the sliding movement of the cover 20 relative to the body 10 is limited.

In the state illustrated in FIG. 14, a space is formed between the body 10 and the cover 20. Particularly, as is apparent by comparing FIGS. 7 and 14, the space between the sheet guide 21 and the platen roller 40 attached to the cover 20 and the thermal head 30 provided in the body 10 is widened by drawing out the cover 20. Jammed paper 100 can be removed through the widened space. Thus, jammed paper 100 can be removed by just sliding the cover 20 relative to the body 10. In this state, the space between the body 10 and the cover 20 is insufficient to set or replace the paper 100. When the cover 20 is pulled further in the Y2 direction as illustrated in FIG. 15, the cover 20 moves in the Y2 direction.

When the cover 20 is pulled strongly in the Y2 direction, the engaging part 25 presses the protrusion 15*a* in the X2 direction. As a result, the spring 15 bends and the protrusion 15*a* is displaced in the X2 direction. Accordingly, the engaging part 25 can be moved to a position that is closer to the Y2 end of the body 10 than the protrusion 15*a*.

Figure 15:
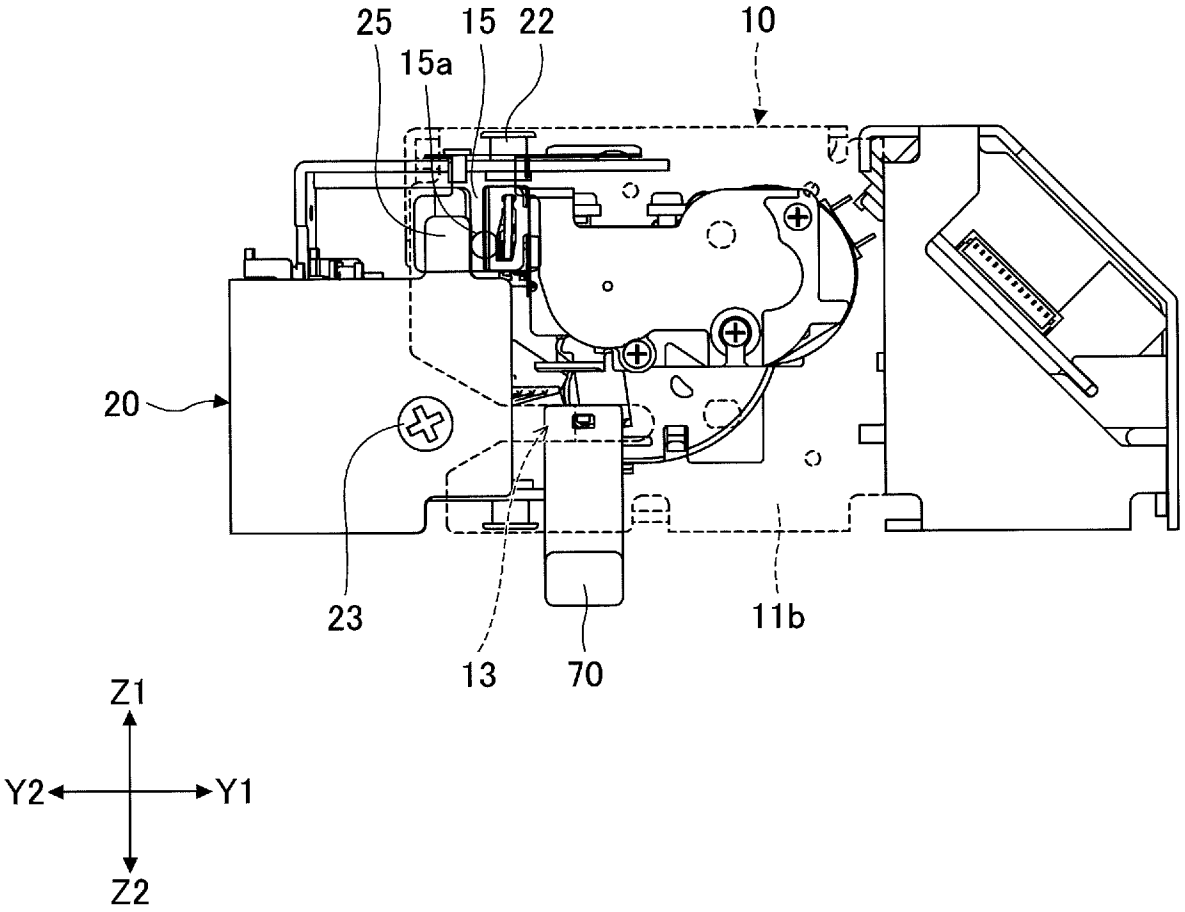
FIG. 15 is a transparent side view of the printer in a state where the cover is rotatable.

In the state illustrated in FIG. 15, the second screw 23 is moved out of the groove 13 through the open Y2 end, and the X1 side of the cover 20 is not connected to the body 10 and can be freely moved. Also in the state illustrated in FIG. 15, the first screw 22 is positioned at the Y2 end of the long hole 12. Accordingly, as illustrated in FIG. 16, the cover 20 can be rotated around the first screw 22 in a direction indicated by a dotted arrow C.

Figure 16:
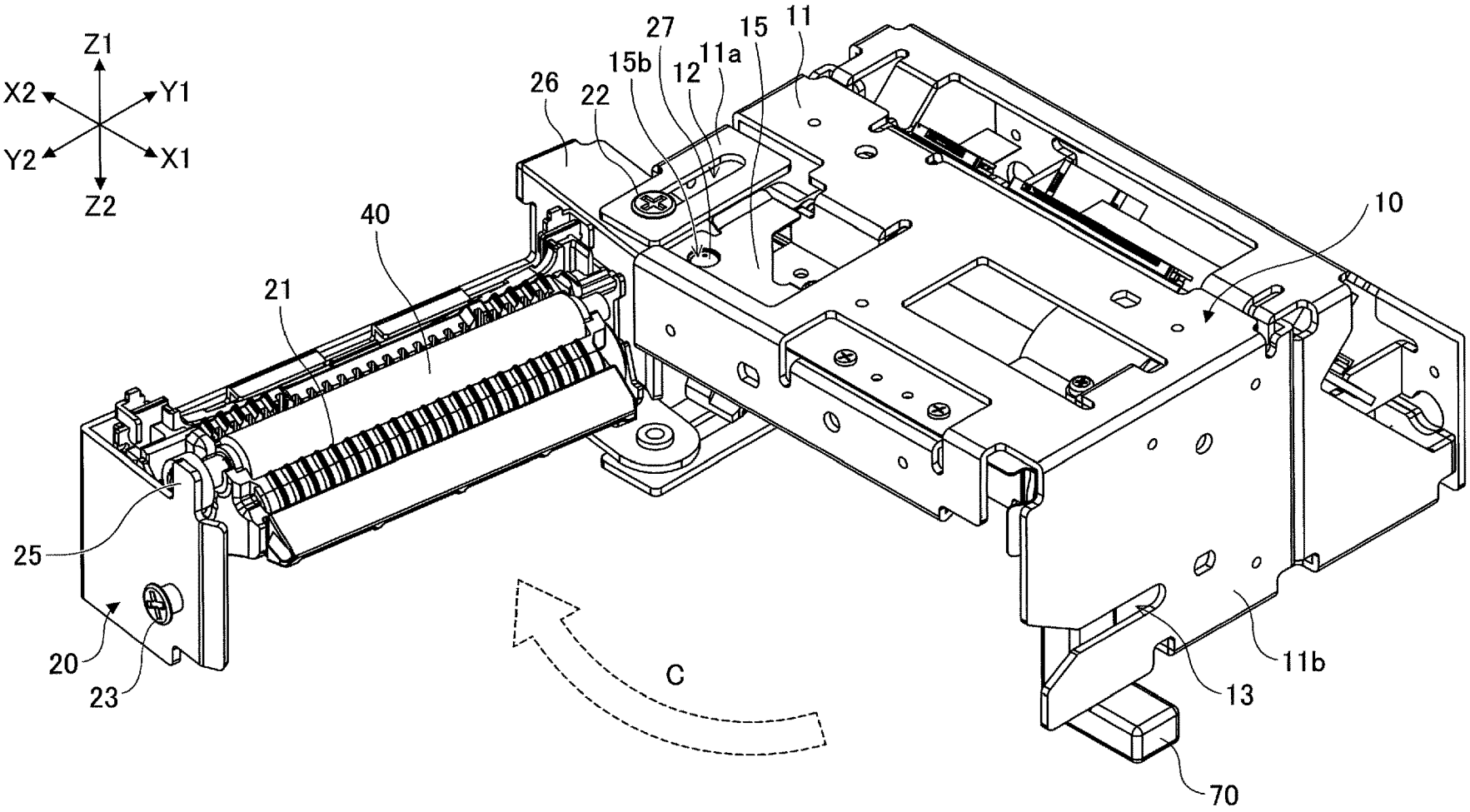
FIG. 16 is a perspective view of the printer whose cover is rotated and opened.
Figure 17:
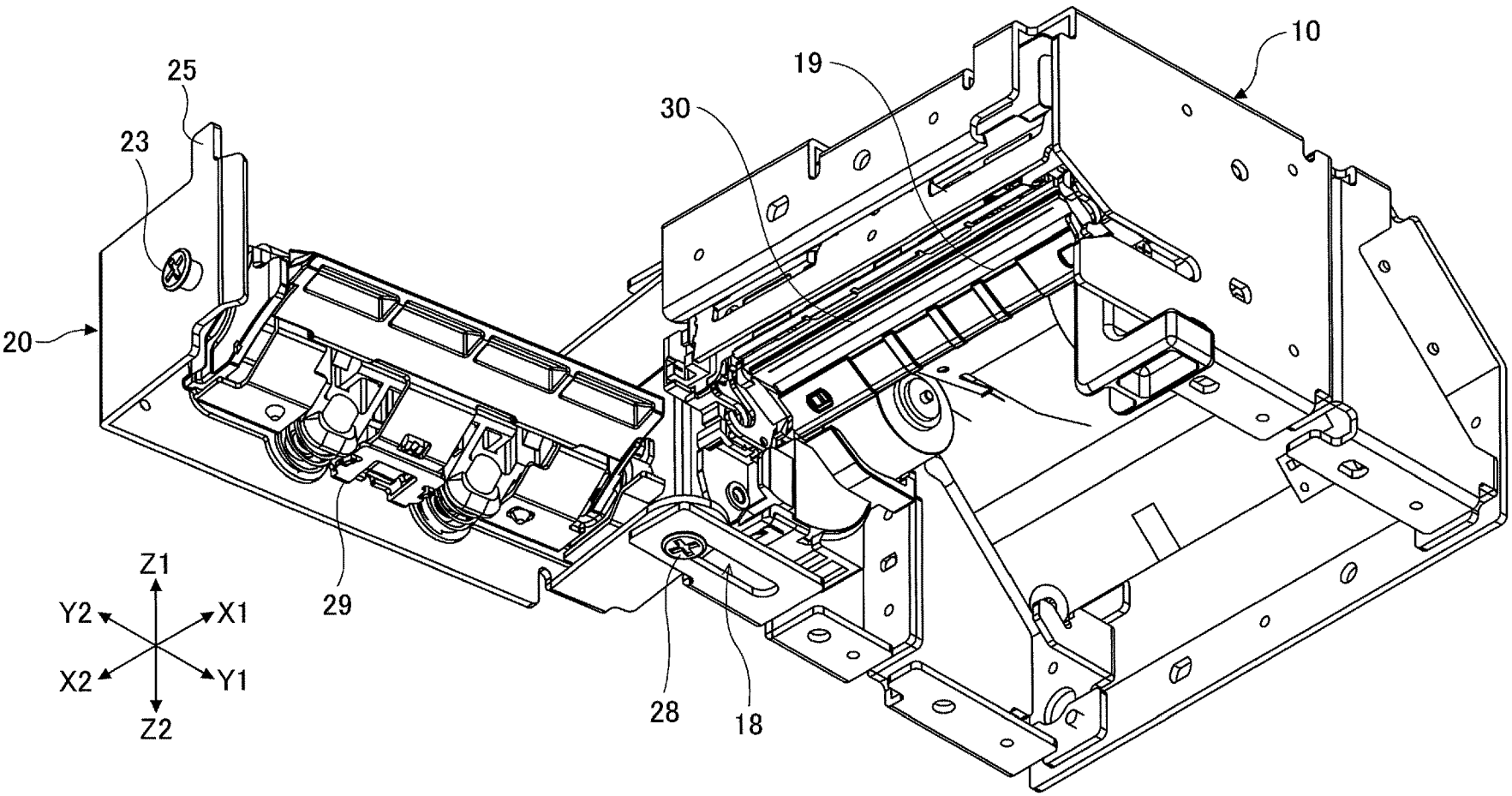
FIG. 17 is a perspective view of the printer whose cover is rotated and opened.
Figure 18:
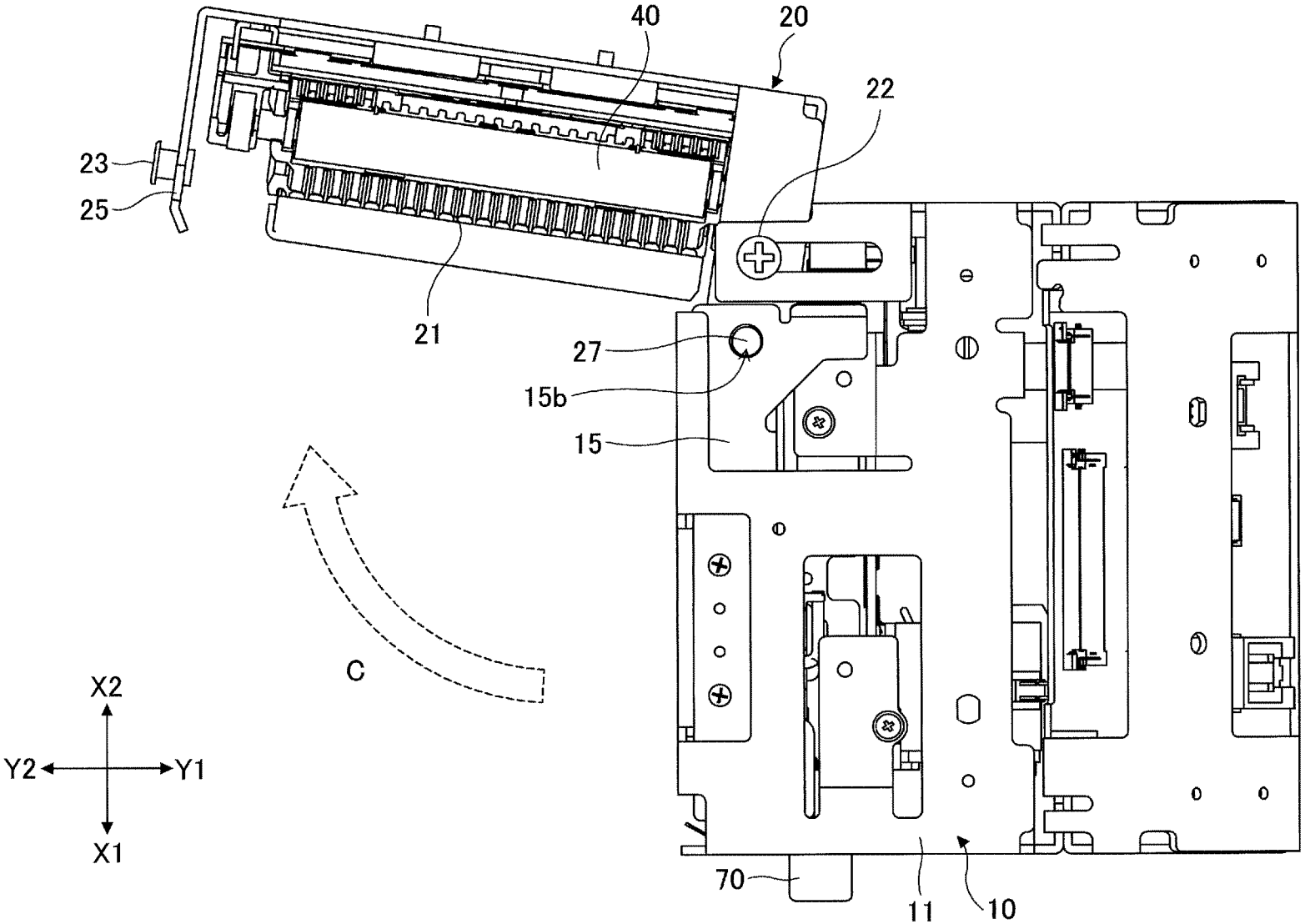
FIG. 18 is a top view of the printer whose cover is rotated and opened.
Figure 19:
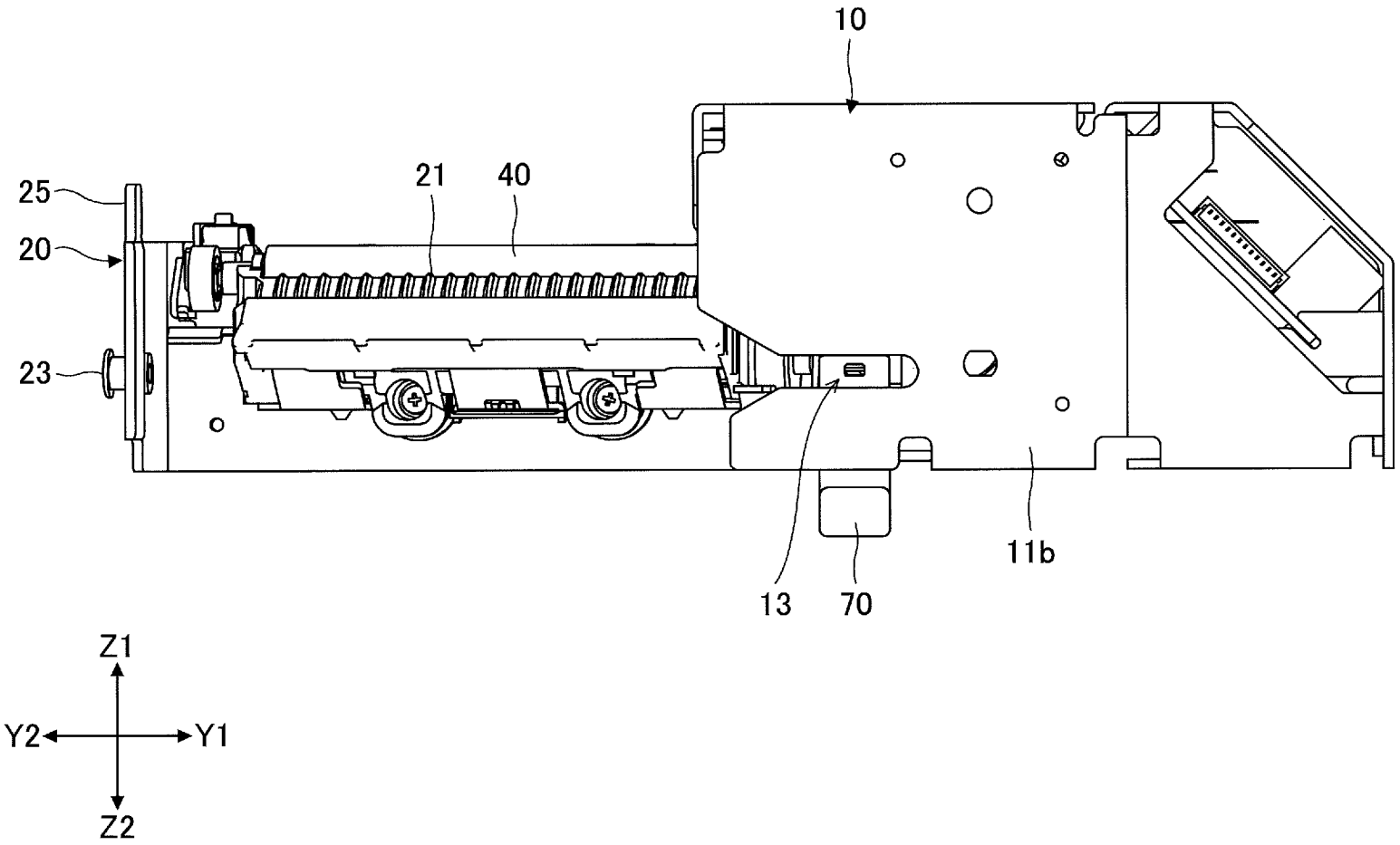
FIG. 19 is a right-side view of the printer whose cover is rotated and opened.
Figure 20:
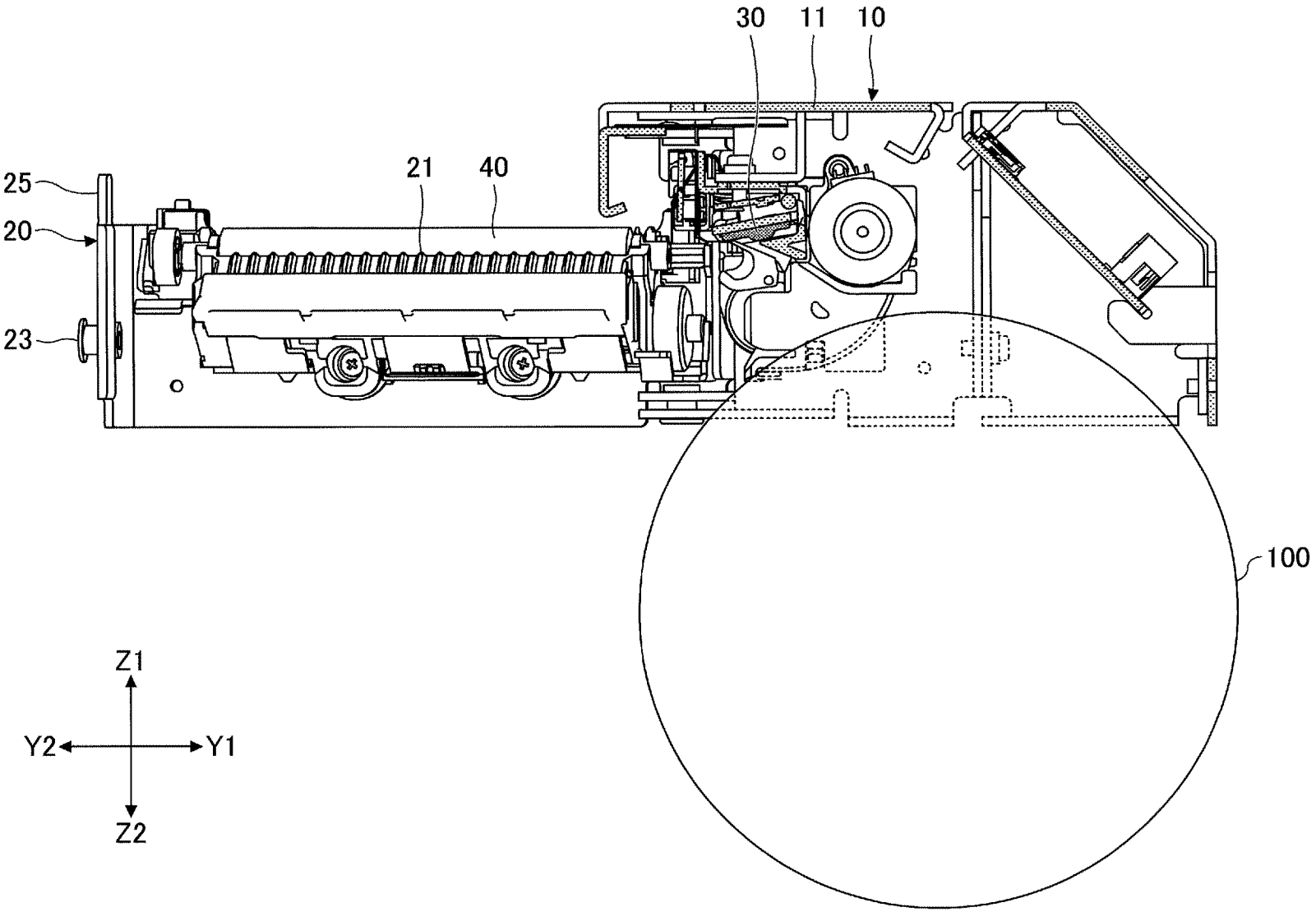
FIG. 20 is a cross-sectional view of the printer whose cover is rotated and opened.

As illustrated in FIGS. 16 through 20, the cover 20 can be fully opened by rotating the cover 20 in the direction indicated by the dotted arrow C. In this state, it is possible to set or replace the paper 100 in the sheet holder. FIG. 16 is a top perspective view, FIG. 17 is a bottom perspective view, FIG. 18 is a top view, FIG. 19 is a right-side view, and FIG. 20 is a cross-sectional view parallel to the YZ plane of the printer where the cover 20 is fully opened. In FIG. 20, the paper 100 is placed in the sheet holder.

In the present embodiment, as illustrated in FIG. 17, a long hole 18 is also formed in the bottom wall of the body 10 at a position corresponding to the long hole 12, and a third screw 28 is attached to the cover 20 at a position corresponding to the first screw 22. The third screw 28 is in the long hole 18, and the cover 20 rotates around an axis defined by the first screw 22 and the third screw 28. The paper 100 is placed in the space of the body 10 illustrated in FIG. 17. When the cover 20 is rotated, the protrusion 27 rotates together with the cover 20. When the cover 20 is rotated to the fully-opened position, the protrusion 27 fits into the hole 15*b*. As a result, the rotation of the cover 20 is stopped, and the cover 20 is kept in the fully-opened position.

In the printer of the present embodiment, as illustrated in FIG. 17, a fixed-blade unit 19 including the thermal head 30 is attached to the body 10, and a movable-blade unit 29 including the platen roller 40 is attached to the cover 20.

As a variation of the present embodiment, a first screw and a second screw may be attached to the body 10, and a long hole and a groove corresponding to the first and second screws may be formed in the cover 20.

An aspect of this disclosure provides a small printer whose cover can be easily opened and closed to set recording paper.

A printer according to the embodiment of the present invention is described above. However, the present invention is not limited to the embodiment, and variations and modifications may be made without departing from the scope of the present invention.

What is claimed is:

1. A printer, comprising:

a body including a side wall and an upper wall that is orthogonal to the side wall;

a cover;

a long hole formed in one of the body and the cover;

a first shaft provided on another one of the body and the cover and disposed to pass through the long hole;

a groove formed in the one of the body and the cover; and a second shaft provided on the another one of the body and the cover and disposed to pass through the groove, wherein the cover is attached to the body so as to be rotatable around the first shaft in a direction parallel to the upper wall of the body;

the groove extends parallel to a longitudinal direction of the long hole;

the cover is slidable relative to the body in a direction parallel to the upper wall of the body while the second shaft is in the groove; and the cover is rotatable around the first shaft when the second shaft is out of the groove.

2. The printer as claimed in claim 1, wherein the body includes a biasing part on one side of which a protrusion is formed;

the cover includes an engaging part configured to contact the protrusion and thereby limit sliding of the cover; and the cover is configured to become rotatable by sliding the cover until the engaging part is positioned closer to an end of the body than the protrusion.

3. The printer as claimed in claim 1, further comprising:

a spring configured to bias the body and the cover in directions away from each other.

* * * * *